US012768119B2

(12) United States Patent
Muhle

(10) Patent No.: US 12,768,119 B2
(45) Date of Patent: Oct. 20, 2026

(54) BRIDGE HEATING DEVICE

(71) Applicant: Muhle & Paradowski LLC, Flower Mound, TX (US)

(72) Inventor: Roger Muhle, Fort Worth, TX (US)

( * ) Notice: Subject to any disclaimer, the term of this patent is extended or adjusted under 35 U.S.C. 154(b) by 297 days.

(21) Appl. No.: 18/794,877

(22) Filed: Aug. 5, 2024

(65) Prior Publication Data

US 2026/0035871 A1 Feb. 5, 2026

(51) Int. Cl.
*E01H 5/10* (2006.01)

(52) U.S. Cl.
CPC ..... *E01H 5/106* (2013.01)

(58) Field of Classification Search
CPC ..... E01H 5/106
See application file for complete search history.

(56) References Cited

U.S. PATENT DOCUMENTS

| | | | | |
|---|---|---|---|---|
| 4,132,074 | A * | 1/1979 | Wendel | F24S 20/02 126/400 |
| D266,060 | S | 9/1982 | Beretta | |
| 6,592,288 | B2 * | 7/2003 | Chun | E01C 9/00 238/14 |
| 8,791,584 | B2 | 7/2014 | Sieger | |
| 9,528,235 | B1 * | 12/2016 | Irving | F24S 10/73 |
| 9,872,342 | B1 * | 1/2018 | Smith | H05B 3/36 |
| 11,788,518 | B1 * | 10/2023 | Henry | F04D 13/086 417/411 |
| 12,658,029 | B2 * | 6/2026 | Karjalainen | G08G 1/0116 |
| 2011/0290776 | A1 | 12/2011 | Yoon | |
| 2017/0342666 | A1 | 11/2017 | Lampe | |
| 2019/0013769 | A1 * | 1/2019 | Wang | E01C 1/002 |

FOREIGN PATENT DOCUMENTS

| | | | | |
|---|---|---|---|---|
| TW | 201122192 A * | 7/2011 | | H02S 20/26 |
| WO | WO03040474 | 5/2003 | | |

* cited by examiner

*Primary Examiner* — Jesse S Bogue

(57) ABSTRACT

A bridge heating device for inhibiting the formation of ice on a bridge includes a power unit positionable upon a roadway of a bridge and a solar panel disposed on a top of the power unit for converting solar energy into electrical energy. A plurality of heating pads is each positionable on the roadway having the plurality of heating pads being daisy chained to extend along a substantial length of the roadway. Each of the plurality of heating pads is in communication with the power unit thereby enabling each of the plurality of heating pads to generate heat when the plurality of heating pads is turned on. Furthermore, each of the plurality of heating pads is in thermal communication with the roadway to inhibit the formation of ice on the roadway thereby enhancing safety for the motorists.

10 Claims, 8 Drawing Sheets

BRIDGE HEATING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to heating devices and more particularly pertains to a new heating devices for inhibiting the formation of ice on a bridge. The device includes a power unit which as a solar panel for converting solar energy into electrical energy and a plurality of heating pads which are electrically coupled to the power unit. The power unit and the plurality of heating pads are each mounted to a roadway on a bridge to enable the plurality of heating pads to heat the roadway thereby inhibiting the formation of ice on the roadway. In this way the plurality of heating pads enhances safety for motorists on the roadway.

(2) Description of Related Art Including Information Disclosed Under 37 CFR 1.97 and 1.98

The prior art relates to heating devices including a variety of roadway warming devices that each at least includes conduits integrated into a roadway and a heating unit in fluid communication with the conduits for pumping a warmed fluid through the conduits to inhibit ice formation on the roadway and a high traction anti-icing device that includes magnetic covers that magnetically engage a bridge and heating tubes integrated into the magnetic covers for warming the bridge and inhibiting the formation of ice on the bridge. In no instance does the prior art disclose a bridge heating device that includes a power unit that is mountable to a roadway on a bridge which includes a solar panel and a plurality of heating panels which each includes heating coils that are mounted to the roadway of the bridge and which are electrically coupled to the power unit for warming the roadway and inhibiting the formation of ice on the roadway.

BRIEF SUMMARY OF THE INVENTION

An embodiment of the disclosure meets the needs presented above by generally comprising a power unit positionable upon a roadway of a bridge and a solar panel disposed on a top of the power unit for converting solar energy into electrical energy. A plurality of heating pads is each positionable on the roadway having the plurality of heating pads being daisy chained to extend along a substantial length of the roadway. Each of the plurality of heating pads is in communication with the power unit thereby enabling each of the plurality of heating pads to generate heat when the plurality of heating pads is turned on. Furthermore, each of the plurality of heating pads is in thermal communication with the roadway to inhibit the formation of ice on the roadway thereby enhancing safety for the motorists.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
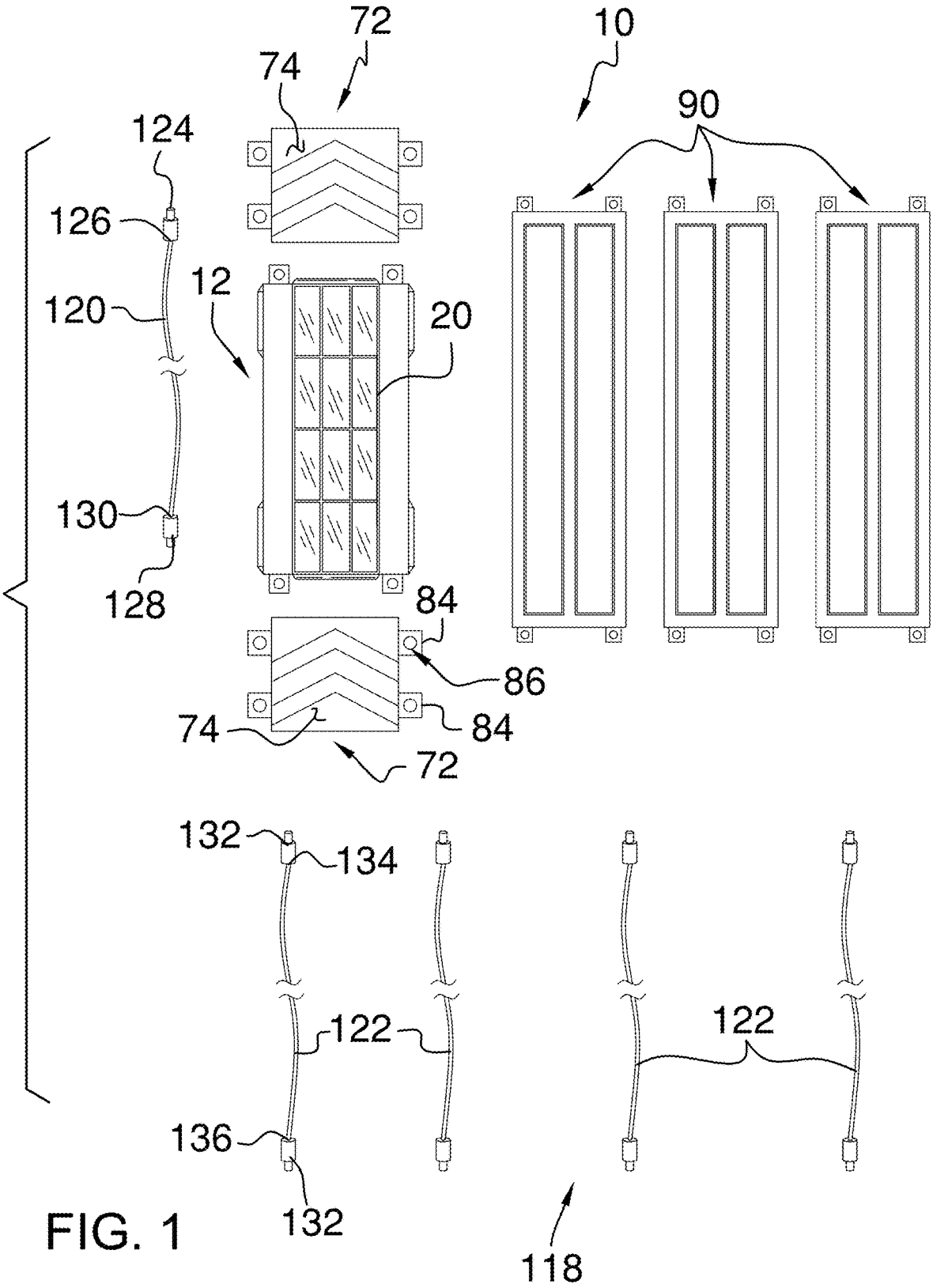
FIG. 1 is a perspective view of a bridge heating device according to an embodiment of the disclosure.
Figure 2:
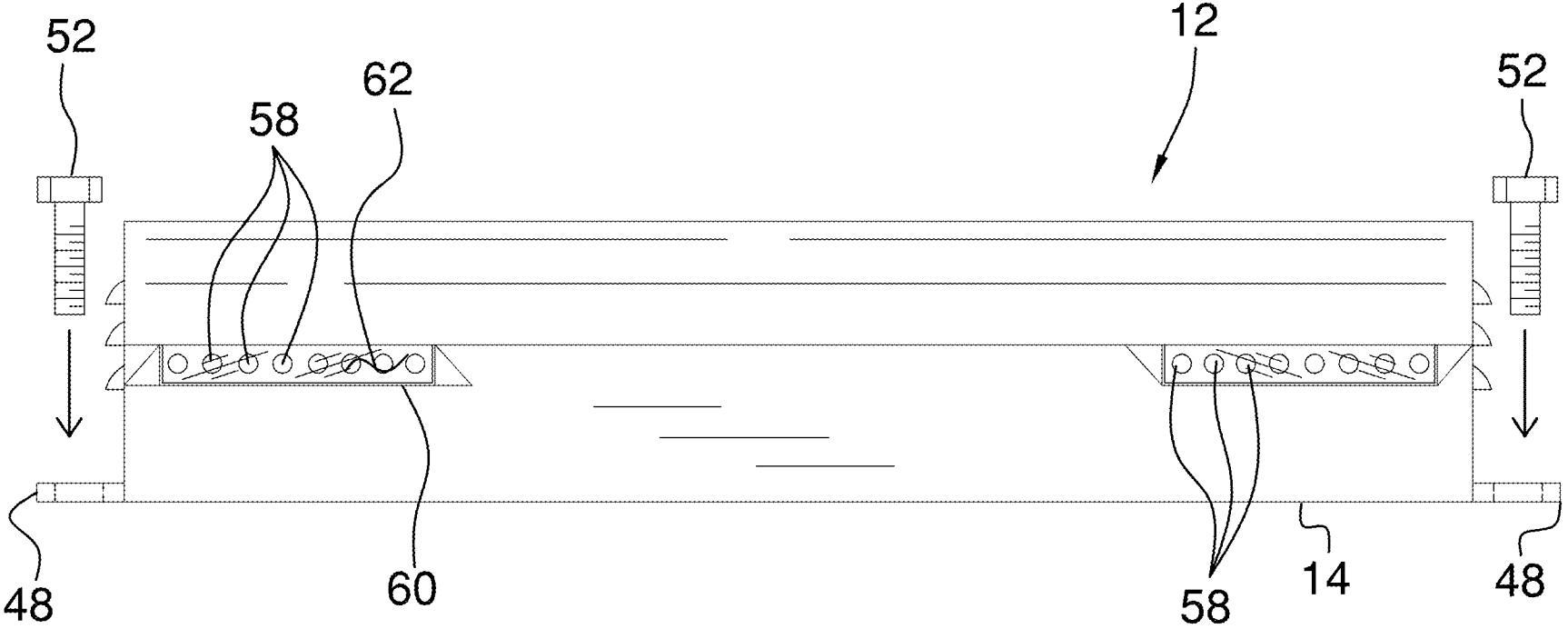
FIG. 2 is a right side view of a power unit of an embodiment of the disclosure.
Figure 4:
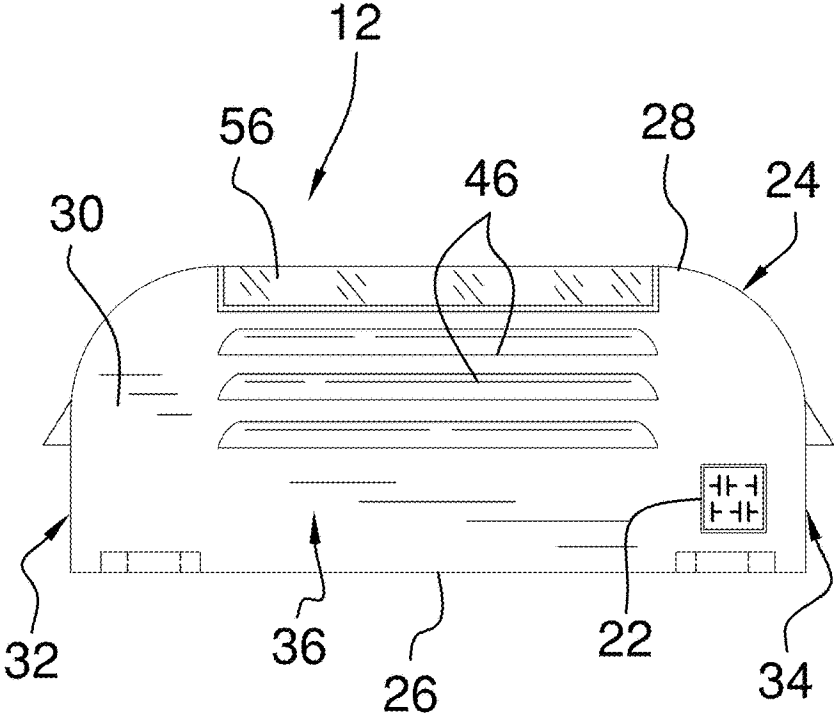
FIG. 4 is a back view of a power unit of an embodiment of the disclosure.
Figure 3:
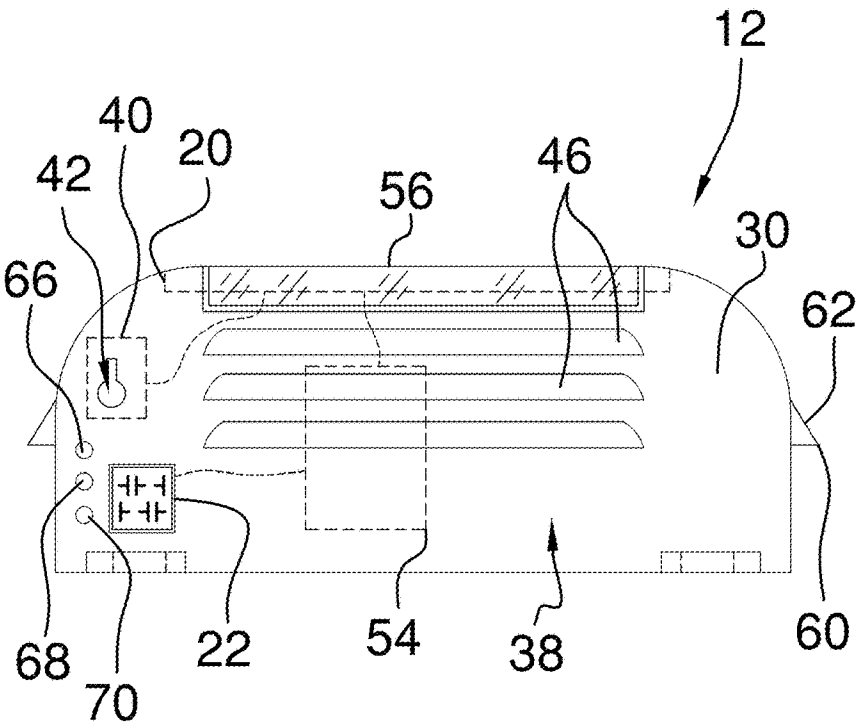
FIG. 3 is a front phantom view of a power unit of an embodiment of the disclosure.
Figure 5:
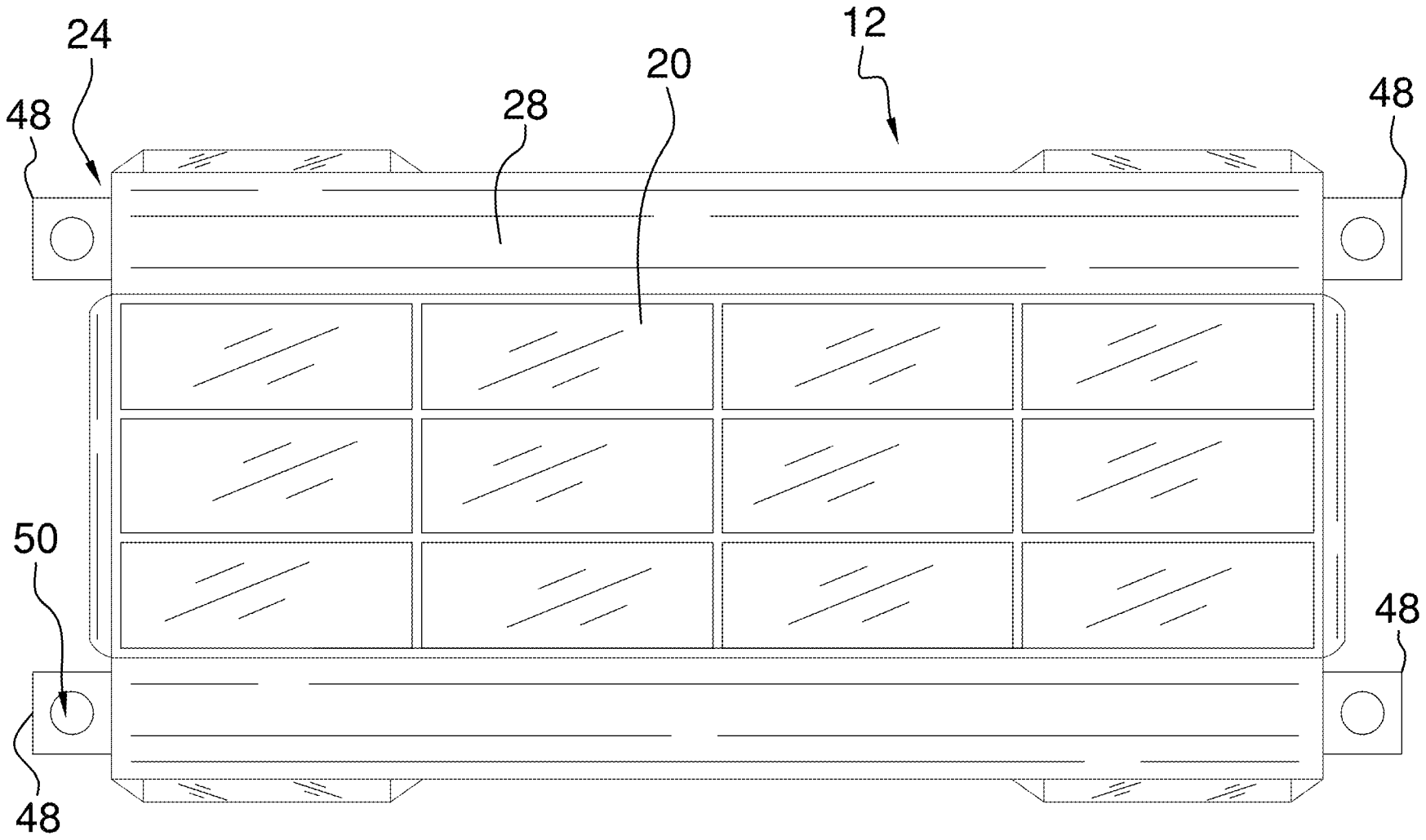
FIG. 5 is a top view of a power unit of an embodiment of the disclosure.
Figure 6:
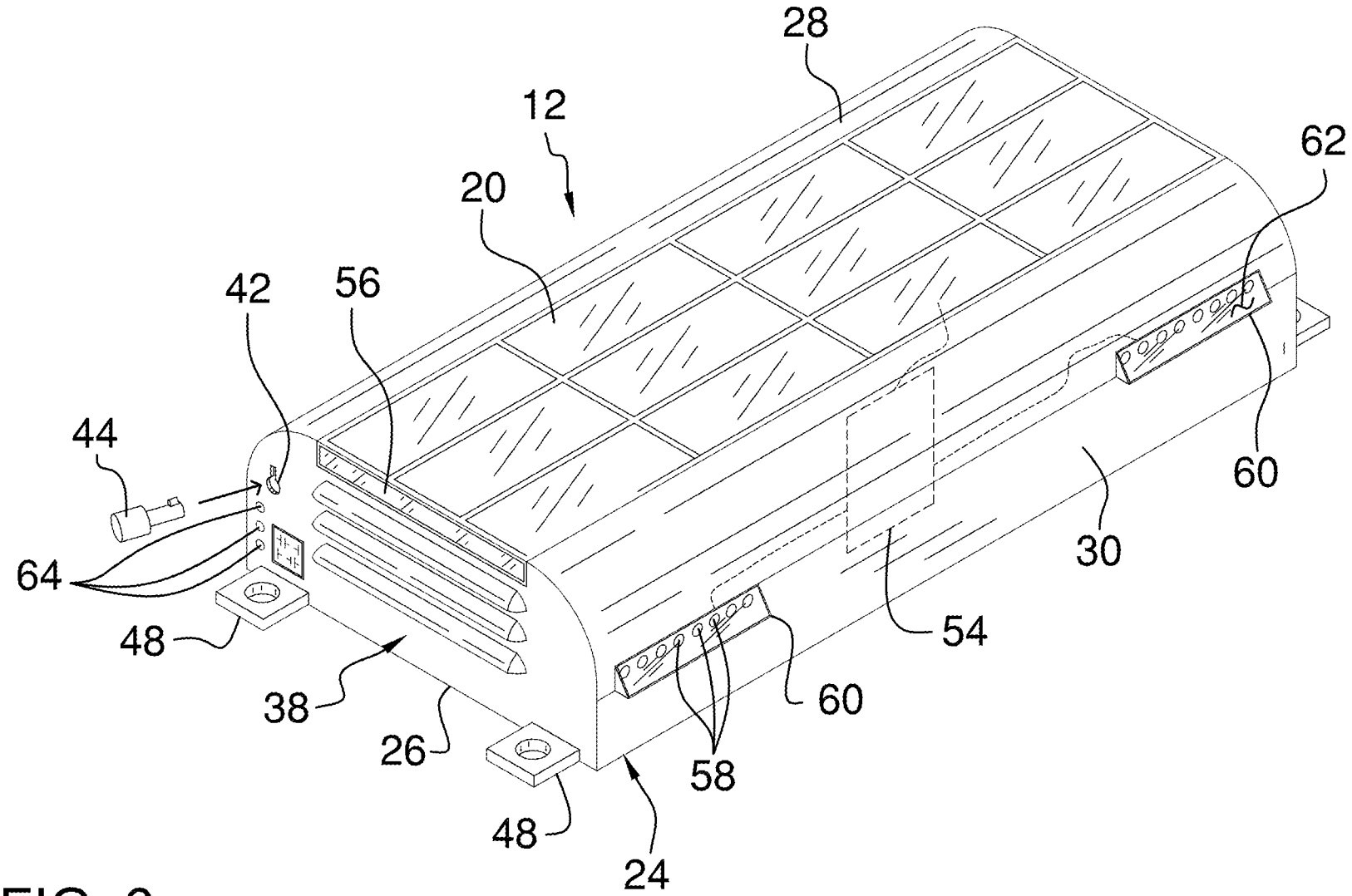
FIG. 6 is a top perspective phantom view of a power unit of an embodiment of the disclosure.

With reference now to the drawings, and in particular to FIGS. 1 through 9 thereof, a new heating devices embodying the principles and concepts of an embodiment of the disclosure and generally designated by the reference numeral 10 will be described.

As best illustrated in FIGS. 1 through 9, the bridge heating device 10 generally comprises a power unit 12 that has a base 14 which is planar thereby enabling the base 14 to rest upon a roadway 16 of a bridge 18. The bridge 18 may include, but not be limited to, a bridge on a state highway or a bridge on an interstate highway and the roadway 16 may include, but not be limited to, an asphalt roadway or a concrete roadway. The power unit 12 has a solar panel 20 which is disposed on a top of the power unit 12 thereby enabling the solar panel 20 to be exposed to sunlight for converting solar energy into electrical energy. Additionally, the power unit 12 has an output port 22 which is in communication with the solar panel 20.

The power unit 12 comprises a housing 24 which has a bottom wall 26 and a top wall 28 and an outer wall 30 extending between the bottom wall 26 and the top wall 28. The bottom wall 26 defines the base 14 of the power unit 12 and the top wall 28 defines the top of the power unit 12. The top wall 28 is curved at an intersection between the top wall 28 and each of a first lateral side 32 and a second lateral side 34 of the outer wall 30. Additionally, the solar panel 20 is mounted to the top wall 28 having the solar panel 20 extending between a front side 36 and a back side 38 of the outer wall 30. The power unit 12 may include a pair of the output ports 22 and each of the pair of output ports 22 may be recessed into a respective one of the back side 38 and the front side 36 of the outer wall 30 and each of the output ports 22 may be electrically coupled to the solar panel 20. The solar panel 20 may be removably mounted to the housing 24 and the housing 24 may include a locking mechanism 40 which releasably engages the solar panel 20. The locking mechanism 40 may include a key hole 42 which extends through the back side 38 of the outer wall 30 for insertably receiving a key 44 to disengage the solar panel 20 from the locking mechanism 40 thereby enabling the solar panel 20 to be removed from the housing 24.

The housing 24 has a plurality of louvers 46 each extending through a respective one of the front side 36 and the back side 38 of the outer wall 30 to ventilate air from an interior of the housing 24. The housing 24 has a plurality of mounting tabs 48 each extending laterally away from a respective one of the front side 36 and the back side 38 of the outer wall 30 and each of the plurality of mounting tabs 48 is aligned with the bottom wall 26. Furthermore, each of the plurality of mounting tabs 48 has a hole 50 for insertably receiving a respective one of a plurality of fasteners 52, such as a bolt for example, thereby enabling the fasteners 52 to engage the roadway 16 of the bridge 18 for securing the housing 24 to the roadway 16.

The power unit 12 includes a charging circuit 54 which is positioned within the housing 24. The charging circuit 54 is electrically coupled between the solar panel 20 and the output port 22 for controlling charging parameters of the solar panel 20. The power includes a pair of reflectors 56 which is each attached to a respective one of the front side 36 and the back side 38 of the outer wall 30 of the housing 24. Each of the pair of reflectors 56 is aligned with the top wall 28 and each of the pair of reflectors 56 is elongated to extend along a horizontal axis. Each of the pair of reflectors 56 is comprised of a light reflecting material to reflect light from headlights of oncoming motorists thereby enabling the housing 24 to be visible to the oncoming motorists at night.

The power unit 12 includes a plurality of lights 58 which is each attached to a respective one of the first lateral side 32 and the second lateral side 34 of the outer wall 30 of the housing 24 to emit light outwardly from the housing 24 for enhancing visibility of the housing 24 for the oncoming motorists. Each of the plurality of lights 58 is electrically coupled to the charging circuit 54 and each of the plurality of lights 58 may comprise a light emitting diode or other type of electronic light. The power unit 12 includes a plurality of lenses 60 which is each mounted to a respective one of the first lateral side 32 and the second lateral side 34 of the outer wall 30. Each of the plurality of lenses 60 is positioned over a respective one of the plurality of lights 58 and each of the plurality of lenses 60 is comprised of a translucent material to pass light through the lenses 60. Additionally, each of the plurality of lenses 60 has an outward surface 62 which is oriented to slope outwardly from the respective first lateral side 32 and the second lateral side 34 of the outer wall 30.

The power unit 12 includes a plurality of status indicators 64 which is each disposed on the back side 38 of the outer wall 30 of the housing 24. Each of the plurality of status indicators 64 is electrically coupled to the charging circuit 54 to visually indicate the operational status of the charging circuit 54. The plurality of status indicators 64 includes an on indicator 66 and an off indicator 68 and a fault indicator 70. The on indicator 66 is actuated when the charging circuit 54 is functioning normally, the off indicator 68 is actuated when the charging circuit 54 is not functioning and the fault indicator 70 is actuated when the charging circuit 54 experiences a malfunction. The on indicator 66 may comprise a green light emitting diode or the like and the off indicator 68 may comprise a red light emitting diode or the like and the fault indicator 70 may comprise a yellow light emitting diode or the like.

Figure 7:
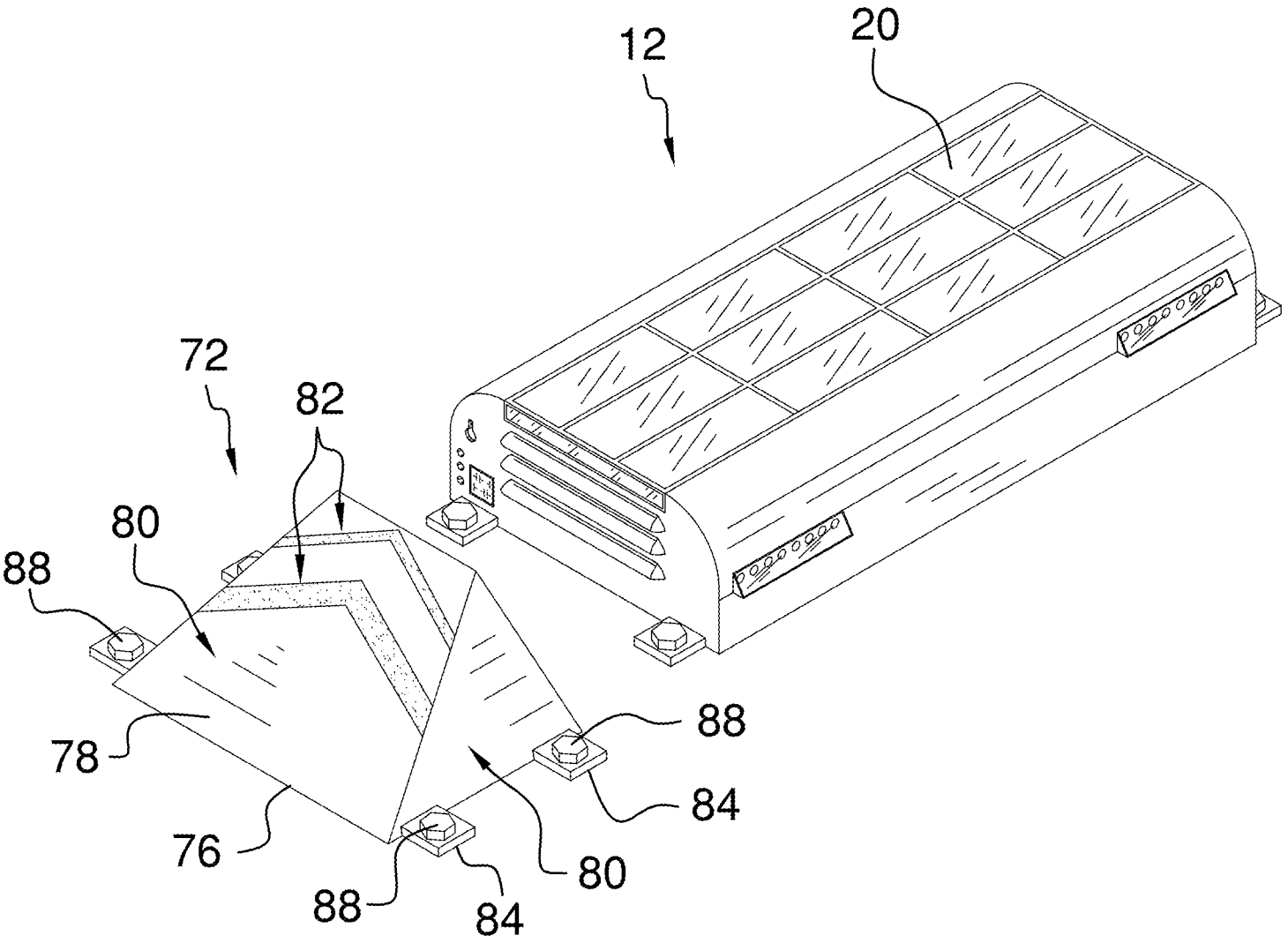
FIG. 7 is a perspective view of a power unit and an end cap of an embodiment of the disclosure.
Figure 8:
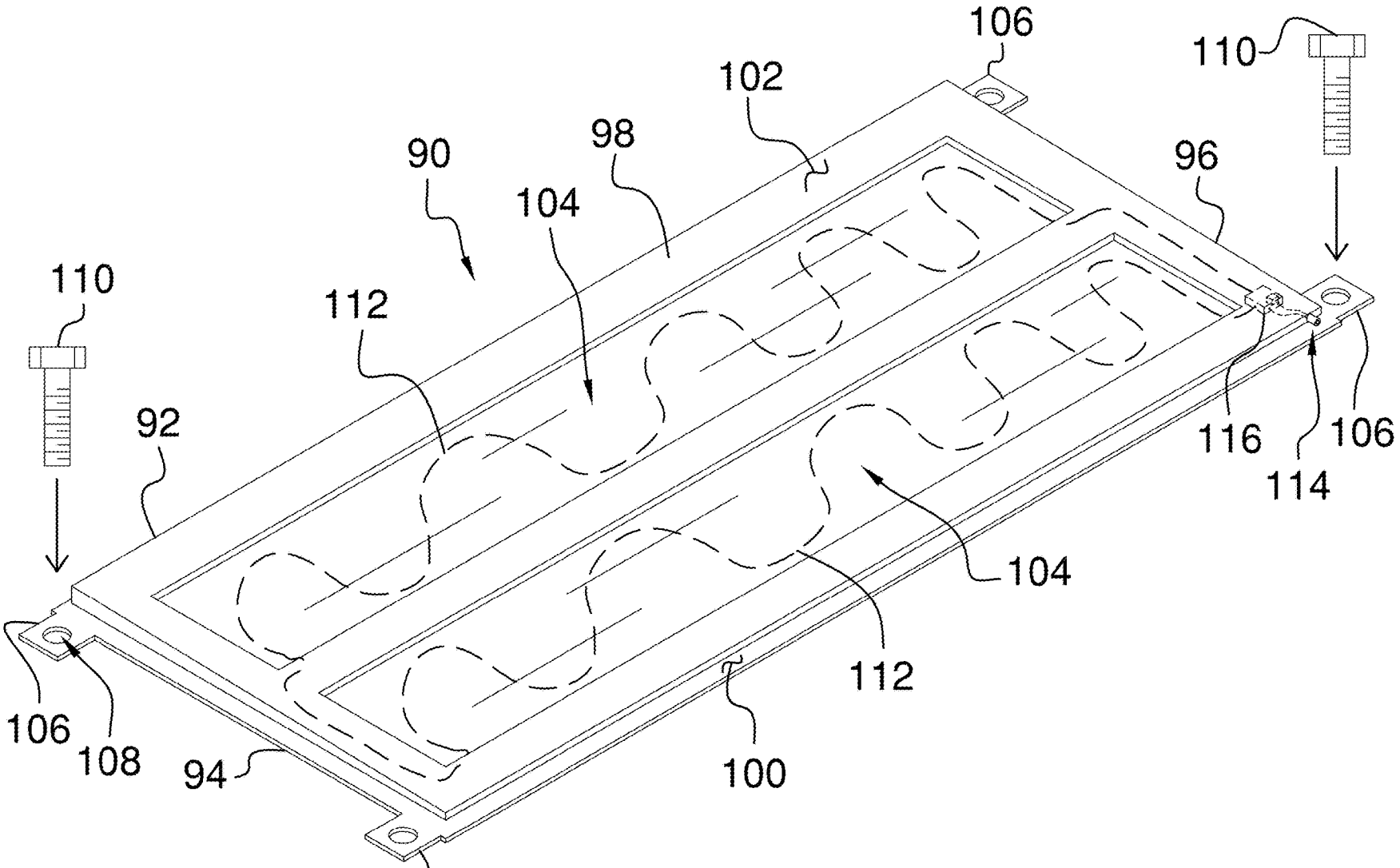
FIG. 8 is a perspective phantom view of a heating pad of an embodiment of the disclosure.
Figure 9:
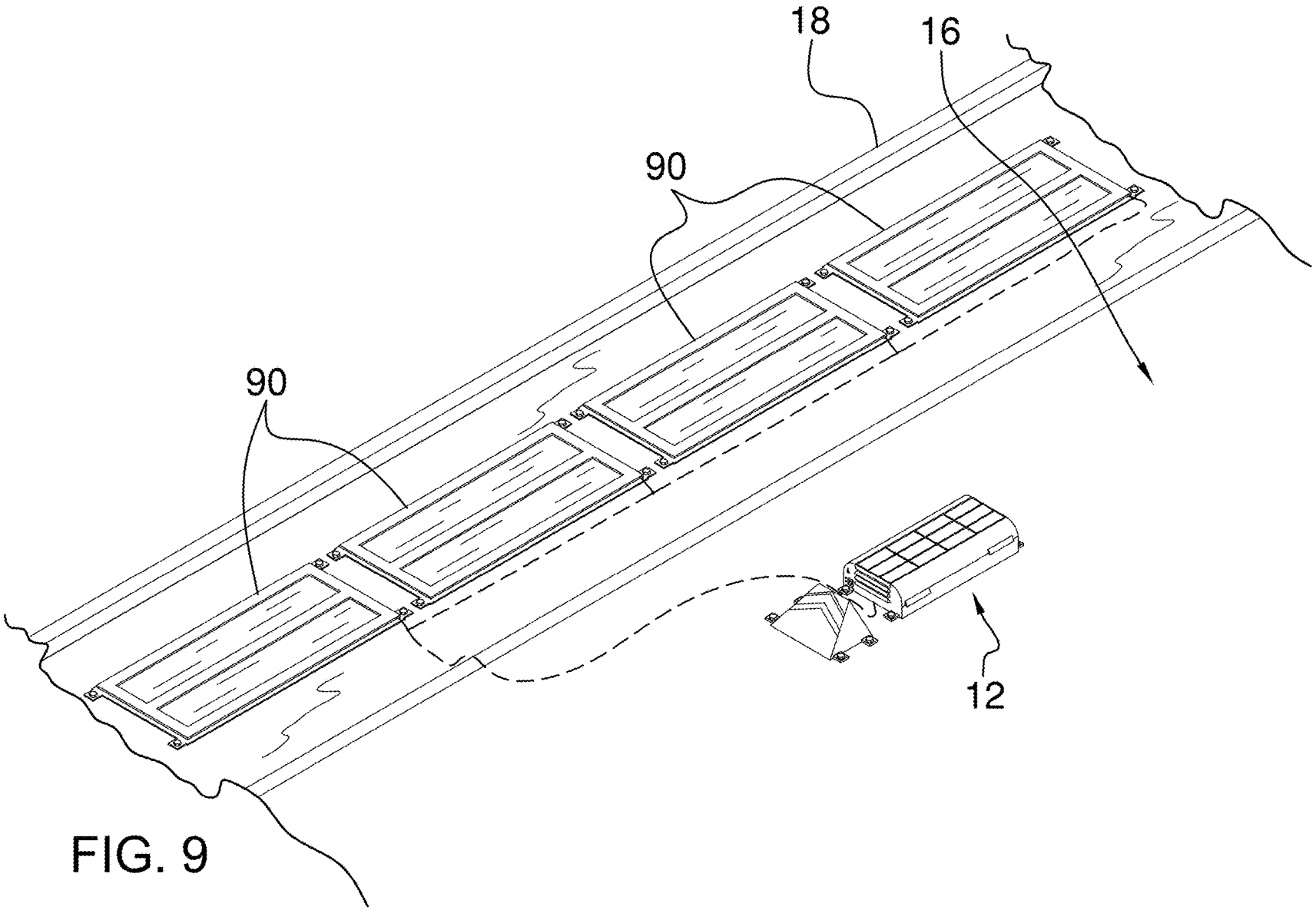
FIG. 9 is a perspective in-use view of an embodiment of the disclosure.

A pair of end caps 72 is provided and each of the pair of end caps 72 has a sloped surface 74 thereby enabling each of the pair of end caps 72 to be positioned against opposite ends of the power unit 12. The sloped surface 74 of each of the pair of end caps 72 slopes upwardly to the top of the power unit 12 to enable a motorist to roll up the sloped surface 74 thereby inhibiting the power unit 12 from being damaged in the event that the motorist inadvertently rolls over the power unit 12. Each of the pair of end caps 72 has a basal wall 76 and an exterior wall 78 extending upwardly from the basal wall 76. The exterior wall 78 has a plurality of intersecting sides 80 each which are oriented at respective angles with each other such that each of the pair of end caps 72 has a trigonal prism shape. Furthermore, a respective one of the plurality of intersecting sides 80 defines the sloped surface 74 of a respective one of the pair of end caps 72. As is shown in FIG. 7, indicia 82 may be applied to the sloped surface 74 which comprises a pair of chevrons oriented to point upwardly along the sloped surface 74.

Each of the pair of end caps 72 has a plurality of mounting tabs 84 each extending laterally away from the exterior wall 78 and each of the plurality of mounting tabs 84 on the pair of end caps 72 is aligned with the basal wall 76 of a respective end cap 72. Each of the plurality of mounting tabs 84 on each of the pair of end caps 72 has a hole 86 for insertably receiving a respective one of a plurality of fasteners 88 thereby enabling the fasteners 88 to engage the roadway 16 thereby securing each of the pair of end caps 72 to the roadway 16.

A plurality of heating pads 90 is provided and each of the plurality of heating pads 90 is positionable on the roadway 16 having the plurality of heating pads 90 being daisy chained to extend along a substantial length of the roadway 16. Each of the plurality of heating pads 90 is in communication with the power unit 12 thereby enabling each of the plurality of heating pads 90 to generate heat when the plurality of heating pads 90 is turned on. Additionally, each of the plurality of heating pads 90 is in thermal communication with the roadway 16 thereby enabling the plurality of heating pads 90 to heat the roadway 16. In this way the plurality of heating pads 90 inhibits the formation of ice on the roadway 16 thereby enhancing safety for the motorists.

Each of the plurality of heating pads 90 comprises a panel 92 which is elongated between a first end 94 and a second end 96 of the panel 92. The panel 92 has a prominence 98 extending upwardly from a top surface 100 of the panel 92 and the prominence 98 covers a substantial area of the top surface 100. Additionally, the prominence 98 has an upper surface 102 which has a pair of depressions 104 each recessed into the upper surface 102 and the pair of depressions 104 is elongated to extend along a substantial length of the prominence 98. The panel 92 has a plurality of mounting tabs 106 each extending laterally away from a respective one of the first end 94 and the second end 96. Additionally, each of the plurality of mounting tabs 106 on the panel 92 has a hole 108 for insertably receiving a respective one of a plurality of fasteners 110 thereby enabling the plurality of fasteners 110 to engage the roadway 16 for securing the panel 92 to the roadway 16. The panel 92 is comprised of a thermally conductive material thereby enabling the panel 92 to be in thermal communication with the roadway 16.

Each of the plurality of heating pads 90 includes a pair of heating coils 112 that is each integrated into the panel 92 thereby enabling each of the pair of heating coils 112 to heat the panel 92 when the pair of heating coils 112 is turned on. In this way the panel 92 is enabled to heat the roadway 16. Each of the pair of heating coils 112 is aligned with a respective one of the pair of depressions 104 in the upper surface of the prominence 98 and each of the pair of heating coils 112 is elongated to extend along a full length of the respective depression. Additionally, each of the pair of heating coils 112 may comprise an electric heating coil with an operation temperature ranging between approximately 100.0 degrees Fahrenheit and 150.0 degrees Fahrenheit. Each of the plurality of heating pads 90 includes an input port 114 which is integrated into the panel 92 and the input port 114 is electrically coupled to each of the pair of heating coils 112.

Each of the heating pads 90 includes a temperature sensor 116 which is integrated into the panel 92 to sense the temperature of ambient air and the temperature sensor 116 is electrically coupled to each of the pair of heating coils 112. The temperature sensor 116 actuates each of the pair of heating coils 112 when the temperature sensor 116 senses a temperature that is below the freezing point of water. Conversely, the temperature sensor 116 de-actuates the pair of heating coils 112 when the temperature sensor 116 senses a temperature that is above the freezing point of water. The temperature sensor 116 may comprise an electronic temperature sensor of any conventional design which has an operational range which ranges between approximately 0.0 degrees Fahrenheit and 100.0 degrees Fahrenheit.

A plurality of conductors 118 is provided and each of the plurality of conductors 118 is attachable between the power unit 12 and the plurality of heating pads 90 thereby enabling the power unit 12 to supply electrical power to each of the plurality of heating pads 90. Additionally, each of the plurality of conductors 118 is comprised of an electrically conductive material, such as a copper for example, and each of the plurality of conductors 118 has weather proof sheathing. The plurality of conductors 118 includes a power unit conductor 120 and a set of heating pad conductors 122. The power unit conductor 120 has a first plug 124 which is electrically coupled to a first end 126 of the power unit conductor 120. The first plug 124 is electrically matable to a respective one of the output ports 22 in the outer wall 30 of the housing 24 of the power unit 12 thereby enabling the power unit conductor 120 to be in electrical communication with the solar panel 20. Additionally, the first plug 124 forms a fluid impermeable seal with the respective output port 22 to inhibit moisture from entering the respective output port 22. The power unit conductor 120 has a second plug 128 which is electrically coupled to a second end 130 of the power unit conductor 120. The second plug 128 is electrically matable to the input port 114 in the panel 92 of a respective one of the plurality of heating pads 90 thereby completing a circuit between the power unit 12 and the respective heating pad 90. Additionally, the second plug 128 forms a fluid impermeable seal with the input port 114 to inhibit moisture from entering the input port 114.

Each of the set of heating pad conductors 122 has a pair of connection plugs 132 each being electrically coupled to a respective first end 134 and second end 136 of a respective heating pad conductor 122. Each of the pair of connection plugs 132 on a respective heating pad conductor 122 is electrically matable to the input port 114 in the panel 92 of a respective pair of the heating pads 90. In this way the plurality of heating pads 90 is enabled to be daisy chained with each other thereby enabling each of the pair of heating coils 112 in the panel 92 of each of the plurality of heating pads 90 to be in electrical communication with the power unit 12. Additionally, the connection plugs 132 on each of the heating pad conductors 122 forms a fluid impermeable seal with the input port 114 to inhibit moisture from entering the input port 114.

In use, the power unit 12 is secured to the roadway 16 in an inconspicuous location on the shoulder 138 of the roadway 16 and the plurality of heating pads 90 is secured to a respective lane 140 of the roadway 16 to form a line extending along a substantial length of the respective lane 140 of the roadway 16 on the bridge 18. In this way the lights 58 on the power unit 12 can serve as a visual indicator of the threshold of the shoulder 138 for the motorists during times of poor visibility. Each of the plurality of conductors 118 is electrically coupled between the power unit 12 and the plurality of heating pads 90 thereby enabling the power unit 12 to supply electrical power to each of the plurality of heating pads 90. In this way the plurality of heating pads 90 can warm the respective lane 140 of the roadway 16 when the temperature drops below the freezing point of water to inhibit the formation of ice on the respective lane 140 of the roadway 16 thereby enhancing safety for the motorists. The power unit 12 can be electrically coupled to an existing power grid during warm weather, for example, to direct electrical energy produced by the solar panel 20 into the existing power grid.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bridge heating device for heating a bridge in cold weather to inhibit the formation of ice on the bridge thereby enhancing safety for motorists crossing the bridge, said device comprising:

a power unit having a base being planar thereby enabling said base to rest upon a roadway of a bridge, said power unit having a solar panel being disposed on a top of said power unit wherein said solar panel is configured to be exposed to sunlight for converting solar energy into electrical energy, said power unit having an output port being in communication with said solar panel;

a pair of end caps, each of said pair of end caps having a sloped surface thereby enabling each of said pair of end caps to be positioned against opposite ends of said power unit having said sloped surface of each of said pair of end caps sloping upwardly to said top of said power unit wherein said pair of end caps is configured to enable a motorist to roll up said sloped surface thereby inhibiting said power unit from being damaged in the event that the motorist inadvertently rolls over said power unit; and a plurality of heating pads, each of said plurality of heating pads being positionable on said roadway having said plurality of heating pads being daisy chained to extend along a substantial length of said roadway, each of said plurality of heating pads being in communication with said power unit thereby enabling each of said plurality of heating pads to generate heat when said plurality of heating pads is turned on, each of said plurality of heating pads being in thermal communication with said roadway thereby enabling said plurality of heating pads to heat said roadway wherein said plurality of heating pads is configured to inhibit the formation of ice on said roadway thereby enhancing safety for the motorists.

2. The device according to claim 1, wherein:

said power unit includes a housing having a bottom wall and a top wall and an outer wall extending between said bottom wall and said top wall;

said bottom wall defines said base of said power unit;

said top wall defines said top of said power unit;

said top wall is curved at an intersection between said top wall and each of a first lateral side and a second lateral side of said outer wall;

said solar panel is mounted to said top wall having said solar panel extending between a front side and a back side of said outer wall;

said output port is recessed into said back side of said outer wall;

said output port is electrically coupled to said solar panel;

said housing has a plurality of louvers each extending through a respective one of said front side and said back side of said outer wall wherein each of said plurality of louvers is configured to ventilate air from an interior of said housing;

said housing has a plurality of mounting tabs each extending laterally away from a respective one of said front side and said back side of said outer wall;

each of said plurality of mounting tabs is aligned with said bottom wall; and each of said plurality of mounting tabs has a hole for insertably receiving a respective one of a plurality of fasteners thereby enabling said fasteners to engage said roadway of said bridge for securing said housing to said roadway.

3. The device according to claim 2, wherein:

said power unit includes a charging circuit being positioned within said housing;

said charging circuit is electrically coupled between said solar panel and said output port for controlling charging parameters of said solar panel;

said power unit includes a pair of reflectors;

each of said pair of reflectors is attached to a respective one of said front side and said back side of said outer wall of said housing;

each of said pair of reflectors is aligned with said top wall;

each of said pair of reflectors is elongated to extend along a horizontal axis;

each of said pair of reflectors is comprised of a light reflecting material wherein each of said pair of reflectors is configured to reflect light from headlights of oncoming motorists thereby enabling said housing to be visible to the oncoming motorists at night;

said power unit includes a plurality of lights;

each of said plurality of lights is attached to a respective one of said first lateral side and said second lateral side of said outer wall of said housing wherein each of said plurality of lights is configured to emit light outwardly from said housing for enhancing visibility of said housing for the oncoming motorists;

each of said plurality of lights is electrically coupled to said charging circuit;

said power unit includes a plurality of lenses;

each of said plurality of lenses is mounted to a respective one of said first lateral side and said second lateral side of said outer wall;

each of said plurality of lenses is positioned over a respective one of said plurality of lights;

each of said plurality of lenses is comprised of a translucent material wherein each of said plurality of lenses is configured to pass light through said lenses;

each of said plurality of lenses has an outward surface being oriented to slope outwardly from said respective first lateral side and said second lateral side of said outer wall;

said power unit includes a plurality of status indicators;

each of said plurality of status indicators is disposed on said back side of said outer wall of said housing;

each of said plurality of status indicators is electrically coupled to said charging circuit wherein each of said plurality of status indicators is configured to visually indicate the operational status of said charging circuit;

said plurality of status indicators includes an on indicator and an off indicator and a fault indicator;

said on indicator is actuated when said charging circuit is functioning normally;

said off indicator is actuated when said charging circuit is not functioning; and said fault indicator is actuated when said charging circuit experiences a malfunction.

4. The device according to claim 1, wherein:

each of said pair of end caps has a basal wall and an exterior wall extending upwardly from said basal wall;

said exterior wall has a plurality of intersecting sides each being oriented at respective angles with each other such that each of said pair of end caps has a trigonal prism shape;

a respective one of said plurality of intersecting sides defines said sloped surface of a respective one of said pair of end caps;

each of said pair of end caps has a plurality of mounting tabs each extending laterally away from said exterior wall;

each of said plurality of mounting tabs on said pair of end caps is aligned with said basal wall of a respective end cap; and each of said plurality of mounting tabs on each of said pair of end caps has a hole for insertably receiving a respective one of a plurality of fasteners thereby enabling said fasteners to engage the roadway thereby securing each of said pair of end caps to said roadway.

5. The device according to claim 1, wherein:

each of said plurality of heating pads includes a panel being elongated between a first end and a second end of said panel;

said panel has a prominence extending upwardly from a top surface of said panel;

said prominence covers a substantial area of said top surface;

said prominence has an upper surface which has a pair of depressions each being recessed into said upper surface;

said pair of depressions is elongated to extend along a substantial length of said prominence;

said panel has a plurality of mounting tabs each extending laterally away from a respective one of said first end and said second end;

each of said plurality of mounting tabs on said panel has a hole for insertably receiving a respective one of a plurality of fasteners thereby enabling said plurality of fasteners to engage said roadway for securing said panel to said roadway; and said panel is comprised of a thermally conductive material thereby enabling said panel to be in thermal communication with said roadway.

6. The device according to claim 5, wherein:

each of said plurality of heating pads includes a pair of heating coils;

each of said pair of heating coils is integrated into said panel thereby enabling each of said pair of heating coils to heat said panel when said pair of heating coils is turned on thereby enabling said panel to heat said roadway;

each of said pair of heating coils is aligned with a respective one of said pair of depressions in said upper surface of said prominence;

each of said pair of heating coils is elongated to extend along a full length of said respective depression;

each of said plurality of heating pads includes an input port being integrated into said panel; and said input port being electrically coupled to each of said pair of heating coils.

7. The device according to claim 6, wherein:

of said plurality of heating pads includes a temperature sensor being integrated into said panel wherein said temperature sensor is configured to sense the temperature of ambient air;

said temperature sensor is electrically coupled to each of said pair of heating coils;

said temperature sensor actuates each of said pair of heating coils when said temperature sensor senses a temperature that is below the freezing point of water; and said temperature sensor de-actuates said pair of heating coils when said temperature sensor senses a temperature that is above the freezing point of water.

8. The device according to claim 1, wherein:

said power unit includes a housing having an outer wall which has a back side;

said power unit includes an output port being recessed into said back side;

each of said plurality of heating pads includes a panel and an input port being integrated into said panel;

said device includes a plurality of conductors;

each of said plurality of conductors is attachable between said power unit and said plurality of heating pads thereby enabling said power unit to supply electrical power to each of said plurality of heating pads;

each of said plurality of conductors is comprised of an electrically conductive material;

said plurality of conductors includes a power unit conductor and a set of heating pad conductors;

said power unit conductor has a first plug being electrically coupled to a first end of said power unit conductor;

said first plug is electrically matable to said output port in said back side of said outer wall of said housing of said power unit thereby enabling said power unit conductor to be in electrical communication with said solar panel;

said power unit conductor has a second plug being electrically coupled to a second end of said power unit conductor; and said second plug is electrically matable to said input port in said panel of a respective one of said plurality of heating pads thereby completing a circuit between said power unit and said respective heating pad.

9. The device according to claim 8, wherein:

each of said set of heating pad conductors has a pair of connection plugs each being electrically coupled to a respective first end and second end of a respective heating pad conductor; and each of said pair of connection plugs on a respective heating pad conductor is electrically matable to said input port in said panel of a respective pair of said heating pads thereby enabling said plurality of heating pads to be daisy chained with each other to enable each of said pair of heating coils in said panel of each of said plurality of heating pads to be in electrical communication with said power unit.

10. A bridge heating device for heating a bridge in cold weather to inhibit the formation of ice on the bridge thereby enhancing safety for motorists crossing the bridge, said device comprising:

a power unit having a base being planar thereby enabling said base to rest upon a roadway of a bridge, said power unit having a solar panel being disposed on a top of said power unit wherein said solar panel is configured to be exposed to sunlight for converting solar energy into electrical energy, said power unit having an output port being in communication with said solar panel, said power unit comprising:

a housing having a bottom wall and a top wall and an outer wall extending between said bottom wall and said top wall, said bottom wall defining said base of said power unit, said top wall defining said top of said power unit, said top wall being curved at an intersection between said top wall and each of a first lateral side and a second lateral side of said outer wall, said solar panel being mounted to said top wall having said solar panel extending between a front side and a back side of said outer wall, said output port being recessed into said back side of said outer wall, said output port being electrically coupled to said solar panel, said housing having a plurality of louvers each extending through a respective one of said front side and said back side of said outer wall wherein each of said plurality of louvers is configured to ventilate air from an interior of said housing, said housing having a plurality of mounting tabs each extending laterally away from a respective one of said front side and said back side of said outer wall, each of said plurality of mounting tabs being aligned with said bottom wall, each of said plurality of mounting tabs having a hole for insertably receiving a respective one of a plurality of fasteners thereby enabling said fasteners to engage said roadway of said bridge for securing said housing to said roadway;

a charging circuit being positioned within said housing, said charging circuit being electrically coupled between said solar panel and said output port for controlling charging parameters of said solar panel;

a pair of reflectors, each of said pair of reflectors being attached to a respective one of said front side and said back side of said outer wall of said housing, each of said pair of reflectors being aligned with said top wall, each of said pair of reflectors being elongated to extend along a horizontal axis, each of said pair of reflectors being comprised of a light reflecting material wherein each of said pair of reflectors is configured to reflect light from headlights of oncoming motorists thereby enabling said housing to be visible to the oncoming motorists at night;

a plurality of lights, each of said plurality of lights being attached to a respective one of said first lateral side and said second lateral side of said outer wall of said housing wherein each of said plurality of lights is configured to emit light outwardly from said housing for enhancing visibility of said housing for the oncoming motorists, each of said plurality of lights being electrically coupled to said charging circuit;

a plurality of lenses, each of said plurality of lenses being mounted to a respective one of said first lateral side and said second lateral side of said outer wall, each of said plurality of lenses being positioned over a respective one of said plurality of lights, each of said plurality of lenses being comprised of a translucent material wherein each of said plurality of lenses is configured to pass light through said lenses, each of said plurality of lenses having an outward surface being oriented to slope outwardly from said respective first lateral side and said second lateral side of said outer wall; and a plurality of status indicators, each of said plurality of status indicators being disposed on said back side of said outer wall of said housing, each of said plurality of status indicators being electrically coupled to said charging circuit wherein each of said plurality of status indicators is configured to visually indicate the operational status of said charging circuit, said plurality of status indicators including an on indicator and an off indicator and a fault indicator, said on indicator being actuated when said charging circuit is functioning normally, said off indicator being actuated when said charging circuit is not functioning, said fault indicator being actuated when said charging circuit experiences a malfunction;

a pair of end caps, each of said pair of end caps having a sloped surface thereby enabling each of said pair of end caps to be positioned against opposite ends of said power unit having said sloped surface of each of said pair of end caps sloping upwardly to said top of said power unit wherein said pair of end caps is configured to enable a motorist to roll up said sloped surface thereby inhibiting said power unit from being damaged in the event that the motorist inadvertently rolls over said power unit, each of said pair of end caps having a basal wall and an exterior wall extending upwardly from said basal wall, said exterior wall having a plurality of intersecting sides each being oriented at respective angles with each other such that each of said pair of end caps has a trigonal prism shape, a respective one of said plurality of intersecting sides defining said sloped surface of a respective one of said pair of end caps, each of said pair of end caps having a plurality of mounting tabs each extending laterally away from said exterior wall, each of said plurality of mounting tabs on said pair of end caps being aligned with said basal wall of a respective end cap, each of said plurality of mounting tabs on each of said pair of end caps having a hole for insertably receiving a respective one of a plurality of fasteners thereby enabling said fasteners to engage the roadway thereby securing each of said pair of end caps to said roadway; and a plurality of heating pads, each of said plurality of heating pads being positionable on said roadway having said plurality of heating pads being daisy chained to extend along a substantial length of said roadway, each of said plurality of heating pads being in communication with said power unit thereby enabling each of said plurality of heating pads to generate heat when said plurality of heating pads is turned on, each of said plurality of heating pads being in thermal communication with said roadway thereby enabling said plurality of heating pads to heat said roadway wherein said plurality of heating pads is configured to inhibit the formation of ice on said roadway thereby enhancing safety for the motorists, each of said plurality of heating pads comprising:

a panel being elongated between a first end and a second end of said panel, said panel having a prominence extending upwardly from a top surface of said panel, said prominence covering a substantial area of said top surface, said prominence having an upper surface which has a pair of depressions each being recessed into said upper surface, said pair of depressions being elongated to extend along a substantial length of said prominence, said panel having a plurality of mounting tabs each extending laterally away from a respective one of said first end and said second end, each of said plurality of mounting tabs on said panel having a hole for insertably receiving a respective one of a plurality of fasteners thereby enabling said plurality of fasteners to engage said roadway for securing said panel to said roadway, said panel being comprised of a thermally conductive material thereby enabling said panel to be in thermal communication with said roadway;

a pair of heating coils, each of said pair of heating coils being integrated into said panel thereby enabling each of said pair of heating coils to heat said panel when said pair of heating coils is turned on thereby enabling said panel to heat said roadway, each of said pair of heating coils being aligned with a respective one of said pair of depressions in said upper surface of said prominence, each of said pair of heating coils being elongated to extend along a full length of said respective depression;

a temperature sensor being integrated into said panel wherein said temperature sensor is configured to sense the temperature of ambient air, said temperature sensor being electrically coupled to each of said pair of heating coils, said temperature sensor actuating each of said pair of heating coils when said temperature sensor senses a temperature that is below the freezing point of water, said temperature sensor de-actuating said pair of heating coils when said temperature sensor senses a temperature that is above the freezing point of water; and an input port being integrated into said panel, said input port being electrically coupled to each of said pair of heating coils; and a plurality of conductors, each of said plurality of conductors being attachable between said power unit and said plurality of heating pads thereby enabling said power unit to supply electrical power to each of said plurality of heating pads, each of said plurality of conductors being comprised of an electrically conductive material, said plurality of conductors including a power unit conductor and a set of heating pad conductors, said power unit conductor having a first plug being electrically coupled to a first end of said power unit conductor, said first plug being electrically matable to said output port in said back side of said outer wall of said housing of said power unit thereby enabling said power unit conductor to be in electrical communication with said solar panel, said power unit conductor having a second plug being electrically coupled to a second end of said power unit conductor, said second plug being electrically matable to said input port in said panel of a respective one of said plurality of heating pads thereby completing a circuit between said power unit and said respective heating pad, each of said set of heating pad conductors having a pair of connection plugs each being electrically coupled to a respective first end and second end of a respective heating pad conductor, each of said pair of connection plugs on a respective heating pad conductor being electrically matable to said input port in said panel of a respective pair of said heating pads thereby enabling said plurality of heating pads to be daisy chained with each other to enable each of said pair of heating coils in said panel of each of said plurality of heating pads to be in electrical communication with said power unit.

* * * * *